US008783627B1

(12) United States Patent
Arnold et al.

(10) Patent No.: US 8,783,627 B1
(45) Date of Patent: Jul. 22, 2014

(54) SHIELD DEVICE FOR A SWITCH POINT ADJUSTING ELEMENT

(71) Applicants: James Arnold, Grass Valley, CA (US); Charles W. Bardsley, Grass Valley, CA (US)

(72) Inventors: James Arnold, Grass Valley, CA (US); Charles W. Bardsley, Grass Valley, CA (US)

( * ) Notice: Subject to any disclaimer, the term of this patent is extended or adjusted under 35 U.S.C. 154(b) by 52 days.

(21) Appl. No.: 13/734,605

(22) Filed: Jan. 4, 2013

(51) Int. Cl.
*B61L 5/00* (2006.01)

(52) U.S. Cl.
USPC ..... 246/220; 246/253; 246/393

(58) Field of Classification Search
USPC ..... 246/220, 253, 393, 394, 396, 401
See application file for complete search history.

(56) References Cited

U.S. PATENT DOCUMENTS

| | | | | | |
|---|---|---|---|---|---|
| 2,057,506 | A * | 10/1936 | Scholz | ..... | 246/428 |
| 3,233,097 | A * | 2/1966 | Watkins | ..... | 246/428 |
| 5,348,257 | A * | 9/1994 | Ocampo | ..... | 246/220 |
| 5,806,809 | A * | 9/1998 | Danner | ..... | 246/220 |
| 6,164,601 | A * | 12/2000 | Scheer et al. | ..... | 246/258 |
| 7,267,304 | B2 * | 9/2007 | Scheer | ..... | 246/410 |
| 7,699,272 | B2 * | 4/2010 | Arnold | ..... | 246/220 |
| 7,946,538 | B1 * | 5/2011 | Beaman et al. | ..... | 246/393 |
| 2008/0179467 | A1 * | 7/2008 | Wagner et al. | ..... | 246/220 |

* cited by examiner

*Primary Examiner* — Jason C Smith

(57) ABSTRACT

A shield device for a switch point adjusting element used in combination with a railroad switch. The device includes first and second shells that mate with one another to form a cover having an inner chamber. The inner chamber is sized to loosely enclose the adjusting element. At least one boss having a recessed generally aligns with a guide having a passageway on the cover. A fastener extends at least partially through the passageway to the guide and engages the recess of the boss to hold the first and second shells together.

10 Claims, 3 Drawing Sheets

SHIELD DEVICE FOR A SWITCH POINT ADJUSTING ELEMENT

BACKGROUND OF THE INVENTION

The present invention relates to a novel and useful tamper resistant shield device used to protect an adjusting element for a railroad switch.

Railroad switches are employed to direct trains from one track to another. Such switching normally entails the use of switch rails or points during the switching operation. The points must be moved from one set of rails to another in an efficient and accurate manner to avoid stoppage or derailment of a train. Switch rails which are used in this regard are connected by tie rods and the linkages for actuation by an operating or throw rod. Operating rods must be kept in adjustment so that the switch rails or points fit tightly against stock rails. Operating rods may be automatically or manually thrown and are well known in the art. In this regard, reference is made to U.S. Pat. No. 7,699,272 which describes switch rails and the mechanisms for operating the same, which is incorporated as a whole by reference to the present application.

In the past, the switch rails or points that are connected to the operating rod include an adjustment linkage. Such an adjustment linkage is often referred to as the "point adjuster basket". It is to say, it is important that proper adjustment of the operating rod and connected switch points be properly maintained at the point adjuster basket. Unfortunately, track vibration and vandalism have often resulted in the switch point adjuster basket being in out of kilter.

Thus, there is a need to provide protection for a switch point adjusting element serving as linkage between a switch point and an operating rod in railroad operations.

BRIEF SUMMARY OF THE INVENTION

In accordance with the present invention a novel and useful tamper resistant shield device for an adjusting element associated with a railroad switch is herein provided.

The device of the present invention utilizes first and second shells that are capable of mating with one another to form a cover. The cover possesses an inner chamber which is sized to loosely enclose the adjusting element of a railroad switch. Such an adjusting element is generally referred to as a "point adjuster basket". Such point adjuster basket usually entails an adjusting sleeve nut as well as a jam nut which is intended to fix the position of the sleeve nut along a threaded bar linked to an operating rod. Needless to say, the sleeve nut is employed to position rail points tightly against rails during switching operations.

The first shell is formed with at least one boss, preferably a pair of bosses, which includes a recess. The recess may take the form of an internally threaded surface to accept a threaded fastener. In addition, the second shell is mated to the first shell and includes a guide having a passageway. The passageway lies adjacent the recess of the boss and is capable of accepting the body of the threaded fastener. In this regard, the fastener is formed with a driving end that includes a non-standard driving surface to increase the difficulty of turning the fastener when the threaded portion of the fastener engages the internally threaded surface of boss.

In addition, the cover formed by the first and second shells include first and second flanges which extend from the cover and are spaced from one another at least a distance equal to the dimension of the adjusting element. Thus, movement of the cover, laterally, along the axis of the threaded bar extending to the throw rod or operating rod, is limited. In addition, a spacer may be employed to lie adjacent one of the flanges such that lateral movement of the cover causes engagement of one of the flanges with the spacer. Moreover, a vibration resistance wedge lock washer may be placed between the sleeve nut and jam nut of the point adjusting basket to obviate loosing of the sleeve nut due to vibration of a railroad track, which is linked to the point adjuster basket.

It may be apparent that a novel and useful tamper resistant shield device for an adjusting element of the railroad switch has been hereinabove described.

It is therefore an object of the present invention to provide a tamper resistant shield device for a railroad switch adjusting element which decreases access to the switch point adjusting element.

Another object of the present invention is to provide a shield device for a railroad switch point adjusting element which is readily adaptable to an existing point adjuster basket used in conjunction with switch rails in a railroad switch.

Another object of the present invention is to provide a shield device for a switch point adjusting element that reduces vandalism at railroads switches.

A further object of the present invention is to provide a shield device for a switch point adjusting element which greatly reduces the possibility of train stoppage or derailment on a railroad.

Another object of the present invention is to provide a shield device for a switch point adjusting element which may be easily installed on an existing point adjuster baskets with the addition of minimal parts and the expenditure of minimal labor.

Yet another object of the present invention is to provide a device used to protect a switch point adjusting element which reduces the loosening of sleeve nuts in the point adjuster basket due to track vibration.

The invention possesses other objects and advantages especially as concerns particular characteristics and features thereof which will become apparent as the specification continues.

Reference is made to the following drawings which should be utilized to further understand the invention sought for patenting in the present application.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

Figure 1:
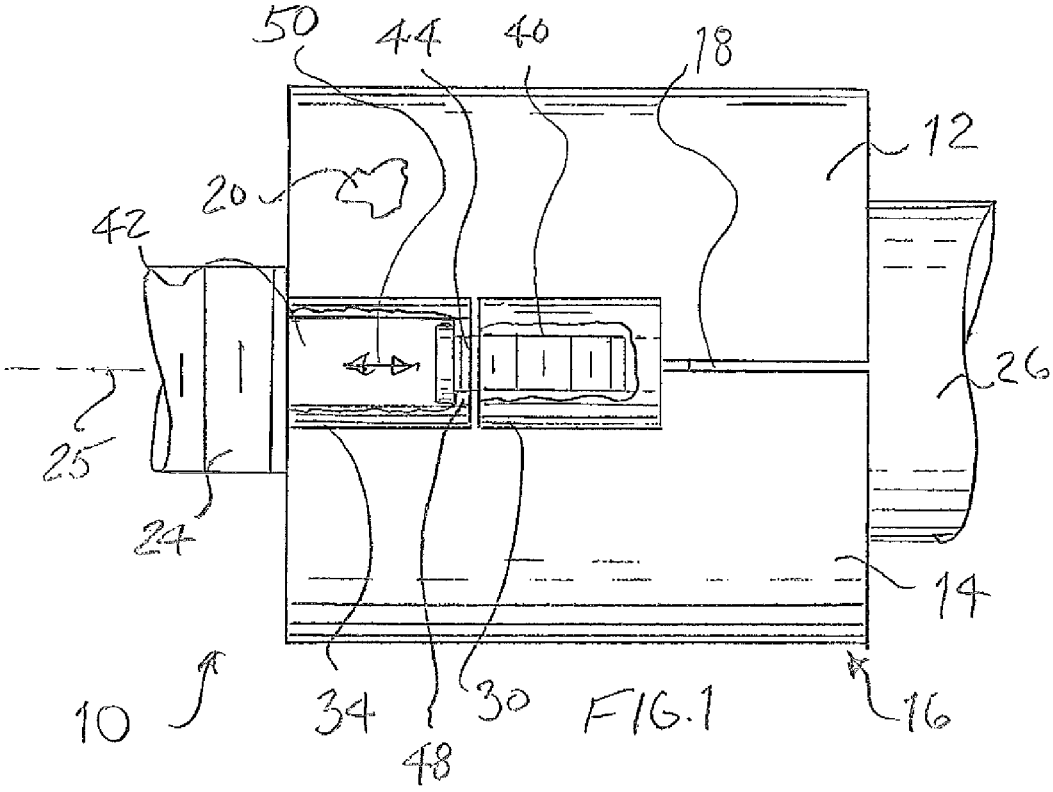
FIG. 1 is a side elevational view of the shield device of the present invention with portions of the guide and boss elements shown in broken-away format.
Figure 2:
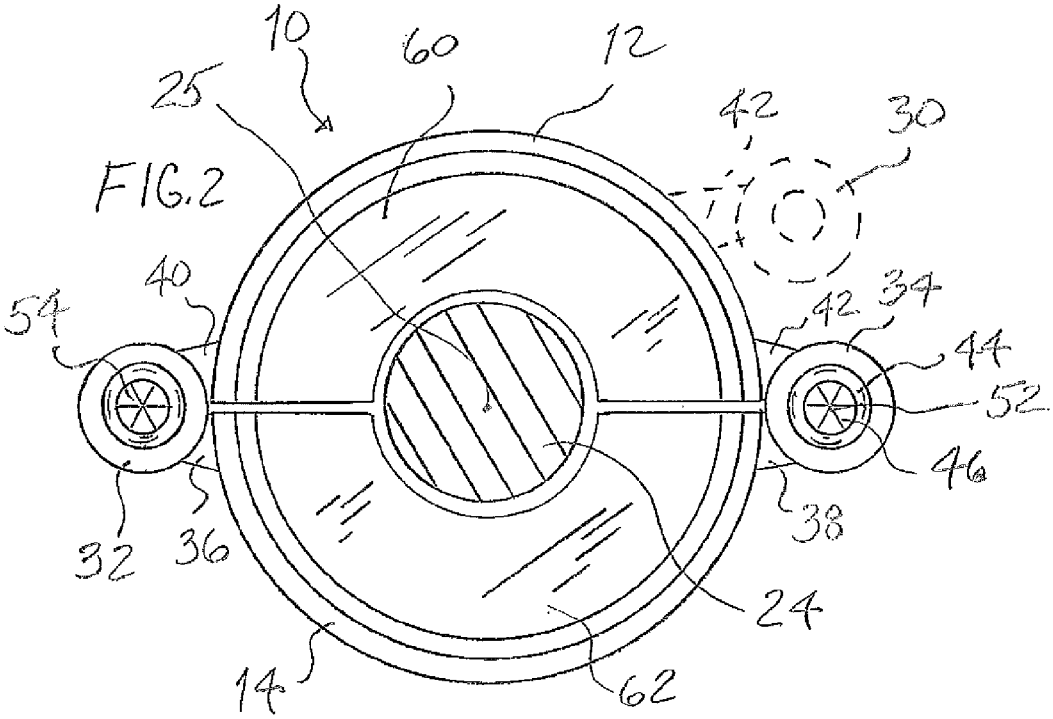
FIG. 2 is a left side elevational view of the device depicted in FIG. 1 showing one of the bosses rotated upwardly and depicted in phantom.
Figure 4:
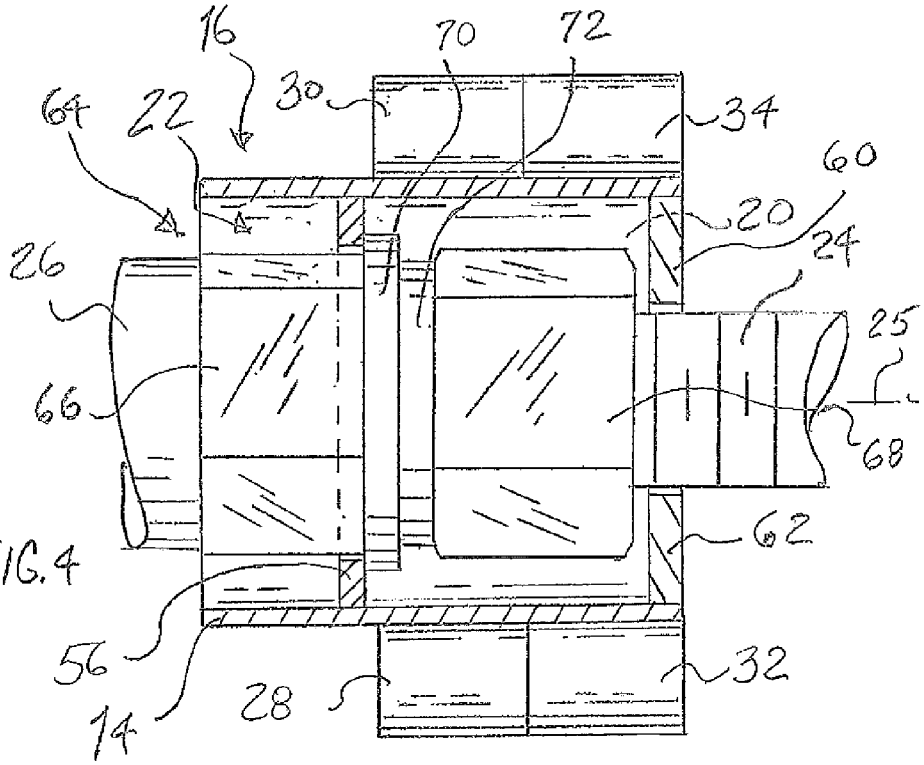
FIG. 4 is a view similar to that shown in FIG. 3 except that the point adjusting elements have been shown within the chamber of a portion of the cover from the present invention.

An embodiment of the invention as a whole is shown in the drawings by reference character 10. Looking at FIGS. 1 and 2, device 10 is formed from a first shell 12 and a second shell 14. Shells 12 and 14 are generally semi-cylindrical bodies, and may be formed of any rigid or semi-rigid materials, such as metal, plastic and the like. As depicted in FIG. 1, shells 12 and 14 mate or align to form a cover 16 with a gap 18 between shells 12 and 14. Cover 16 forms an inner chamber 20 which is intended to mostly enclose a switch point adjusting element or elements 22 which are best shown in FIG. 4 and will be discussed in detail as the specification continues. As shown in FIG. 1, a threaded bar 24 is revealed in part and extends to the operating rod of a railroad switch which is of conventional configuration. Sheath 26 is also shown in part and is linked to the switching rails or points at the track. In this regard, U.S. Pat. No. 5,806,809 is cited to show such linkage mechanisms and is incorporated to the present application as a whole.

Figure 3:
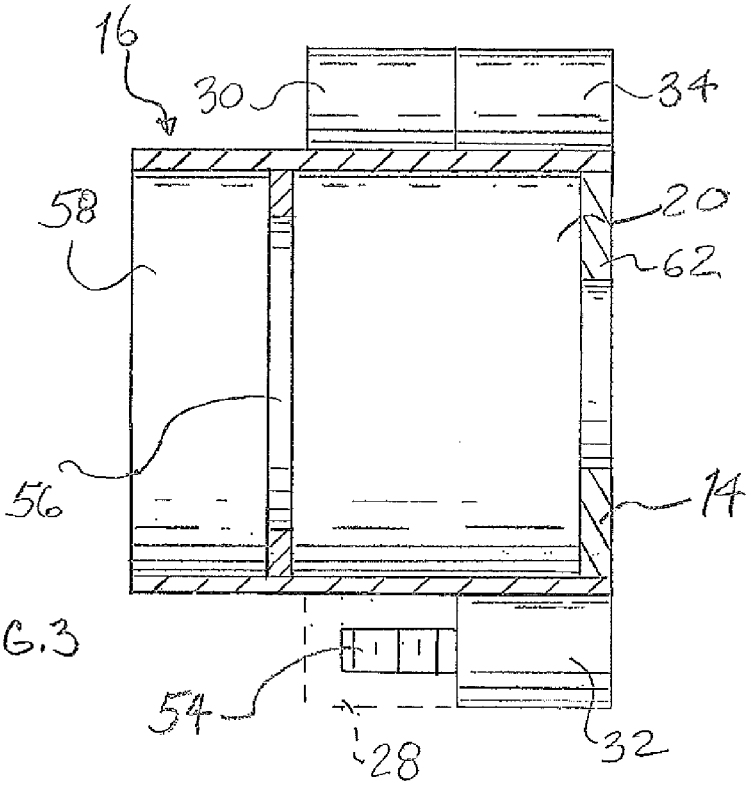
FIG. 3 is a sectional view of the device depicted in FIG. 1 absent the adjusting elements of the railroad switch and with the boss and guide elements depicted in whole, except for a single boss depicted in phantom to reveal the fastener.

The formation of cover 16 includes the provision of bosses 28 and 30 which generally align or lie adjacent to guides 32 and 34. Bosses 28 and 30 and guides 32 and 34 are best shown in FIGS. 3 and 4. In any case, guides 32 and 30 are fixed to shell 14 via welds 36 and 38, FIG. 2. On the other hand, bosses 28 and 34 are fixed to shell 12 by welds 40 and 42. Turning again to FIG. 1, it may be observed that the relationship between boss 30 and guide 34 is depicted. It may be seen, that boss 30 includes a threaded recess 40. Adjacent guide 34 is formed with a passageway 42. When boss 30 and guide 34 are aligned, as shown in FIG. 1, a threaded fastener 44 extends through passageway 42 and threadingly engages threaded recess 40 of boss 30. Driving end 46 bottoms on a shoulder 48 within guide 34 to hold boss 30 to guide 34. Directional arrow 50 indicates the inward and outward movement of fastener 44 with respect to boss 30 and guide 34. Driving end 46 is also provided with a driving surface 52 which is of a non-standard figuration. For example, the present application, driving surface 52 is formed as a standard allen head cap requiring a standard allen wrench (not shown) for its operation. Of course, other non-standard driving surfaces 52 may be employed in the present invention. It may be apparent, the same relationship exist with respect to boss 28 and guide 32 with respect to fastener 54, which serves to hold shells 12 and 14 together in the formation of cover 16.

Referring now to FIG. 3, it may be observed that shell 14 is shown in section and includes a flange in the form of a ridge 56 which extends along the inner surface 58 of shell 12 which is a portion of cover 16. It should be noted that shell 12 also includes a similar ridge. Ridge 56 and another similar ridge with respect to shell 12 are generally semi-circular in configuration. It should also be noted that end surfaces 60 and 62, depending from shells 12 and 14, respectively, together form another flange with respect to cover 16. With respect to FIGS. 3 and 4, it should be noted that ridge 56 and end surface 62 serves as first and second flanges and are spaced from one another a certain distance along cover 16.

Focusing on FIG. 4, it may be apparent that the switch point adjusting elements 64 are depicted within chamber 20 of cover 16. Such adjusting elements 64 include a threaded adjusting sleeve nut 66 and a threaded jam nut 68 which engage threaded bar 24 along the axis 25 of threaded bar 24. It may be observed that cover 16 loosely fits over adjusting sleeve nut 66 and jam nut 68 which greatly reduced the probability of a vandal turning nuts 66 and 68. To prevent lateral movement of cover 16 relative to adjusting elements 64, a spacer 70, in the form of a washer, has been placed over threaded bar 24 between adjusting sleeve nut 66 and jam nut 68. In addition, a vibration resistant wedge lock washer 72 positions adjacent spacer 70 between adjusting sleeve nut 66 and jam nut 68. Thus, cover 16 is confined between spacer 70 and end surfaces 60 and 62 of shells 12 and 14, respectively. It should be observed that spacer 70 engages ridge 56 of shell 14 and another ridge (not shown) shell 12. The sliding of cover 16 a slight distance to the left, as depicted on FIG. 4, would cause jam nut 68 to engage end surfaces 60 and 62. Consequently, the sliding of cover 16 along the axis 25 of threaded rod 24 is limited by the above identified construction.

Figure 5:
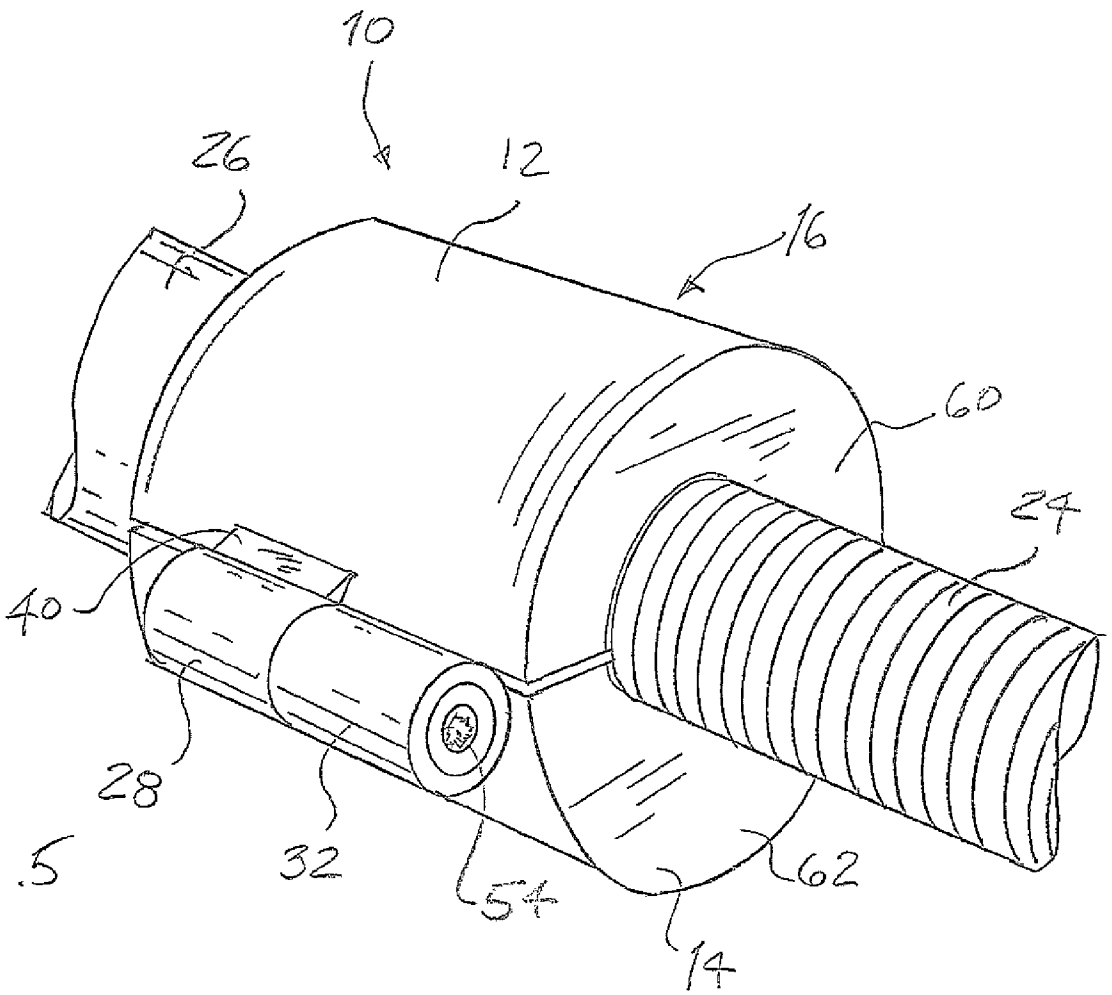
FIG. 5 is a top side perspective view of the device of the present invention in place with the switch point adjusting elements of the railroad switch, shown in part.

FIG. 5 reveals the placement of cover 16 relative to the switch point adjusting elements shown in FIG. 4 and found within chamber 20 of cover 16.

In operation, switch point adjusting elements 64 are shielded or protected by cover 16 which is formed by the mating of shells 12 and 14 over the same. Bosses 28 and 30 accept fasteners 54 and 44, respectively. Fasteners 54 and 44 pass through guides 28 and 30 to cause the general alignment of bosses 28 and 30 with guides 32 and 34, respectively. Fasteners 54 and 44 also hold shells 12 and 14 together with gap 18 therebetween. Cover 16 loosely fits over switch point adjusting elements 64 and is limited in lateral movement along the axis 25 of threaded bar 24 by first and second flanges formed by ridge 56 of shell 14 and another (not shown), of shell 12 as well as end pieces or surfaces 58 and 60, which depends from shells 12 and 14, respectively. Resultant device 10, thus, protects switch point adjusting elements 64 from tampering. It should also be noted that spacer 70 and vibration resistant wedge lock washer 72 reduces the loosening of adjusting sleeve nut 66 and jam nut 68 due to track vibration.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A shield device for a switch point adjusting element of a railroad switch having certain dimension, comprising:

a. a first shell, b. a second shell, said second shell mating with said first shell to form a cover with inner chamber sized to loosely enclose the adjusting elements;

c. one boss, said boss including a recess, said one boss being affixed to said first shell;

d. one guide, said one guide including a passageway there through, said passageway of said one guide lying adjacent said recess of said one boss when said second shell is mating with said first shell;

e. a first flange extending from said cover;

f. a second flange extending from said cover said first and second flanges being spaced from one another, a distance at least equal to the certain dimension of the adjusting element; and g. a fastener said fastener extending at least partially through said passageway of said one guide and engaging said one boss within said recess of said one boss, said fastener holding said one boss to said one guide.

2. The device of claim 1 in which said fastener includes a driving end, said driving end including a non-standard driving surface.

3. The device of claim 1 in which said first flange comprises a ridge extending along said cover within said chamber of said container.

4. The device of claim 3 in which said second flange extends from said cover at the periphery of said cover.

5. The device of claim 4 in which said fastener includes a driving end, said driving end including a standard driving surface.

6. The device of claim 1 in which additionally comprises a spacer, said spacer lying adjacent said first flange and the adjusting element.

7. The device of claim 6 in which said fastener includes a driving end, said driving end including a standard driving surface.

8. The device of claim 6 in which said first flange comprises a ridge extending along said cover within said chamber of said container.

9. The device of claim 8 in which said second flange extends from said cover at the periphery of said cover.

10. The device of claim 9 in which said fastener includes a driving end, said driving end including a standard driving surface.

* * * * *